US006290473B1

(12) United States Patent
Thome et al.

(10) Patent No.: US 6,290,473 B1
(45) Date of Patent: Sep. 18, 2001

(54) FLUID COOLING DEVICE

(75) Inventors: Lothar Thome, Blieskastel; Wolfgang Schabbach, Saarbrucken, both of (DE)

(73) Assignee: Flutec Fluidtechnische Gerate GmbH, Sulzbach (DE)

( * ) Notice: Subject to any disclaimer, the term of this patent is extended or adjusted under 35 U.S.C. 154(b) by 0 days.

(21) Appl. No.: 09/380,311

(22) PCT Filed: Mar. 6, 1998

(86) PCT No.: PCT/EP98/01263

§ 371 Date: Aug. 31, 1999

§ 102(e) Date: Aug. 31, 1999

(87) PCT Pub. No.: WO98/42986

PCT Pub. Date: Oct. 1, 1998

(30) Foreign Application Priority Data

Mar. 20, 1997 (DE) ..... 197 11 591

(51) Int. Cl.[7] ..... F15B 1/26
(52) U.S. Cl. ..... 417/372; 220/565
(58) Field of Search ..... 417/372, 423.8; 220/565, 567.2; 165/47, 132, 80.5

(56) References Cited

U.S. PATENT DOCUMENTS 3,791,766 * 2/1974 Kikutsugi et al. ..... 417/372 X
4,585,398 * 4/1986 Drake ..... 417/372 X
4,854,373 * 8/1989 Williams ..... 165/47 X
5,346,371 * 9/1994 Bialy et al. ..... 417/312
5,509,463 * 4/1996 Callaway, Sr. et al. ..... 165/46
5,542,822 * 8/1996 Stretz et al. ..... 417/372 X
5,542,823 8/1996 de Jong et al. .
5,906,236 * 5/1999 Adams et al. ..... 417/372 X

FOREIGN PATENT DOCUMENTS 2750967 4/1979 (DE) .
3312490 10/1984 (DE) .
4337131 9/1994 (DE) .
0003366 8/1979 (EP) .
0244516 11/1987 (EP) .

* cited by examiner

*Primary Examiner*—John E. Ryznic
(74) *Attorney, Agent, or Firm*—Roylance, Abrams, Berdo & Goodman, L.L.P.

(57) ABSTRACT

A fluid cooling device in the form of a modular unit has a motor which drives a ventilator wheel and a hydraulic pump which takes fluid from an oil reservoir and delivers it to a hydraulic work circuit. The circuit heats the fluid and sends it to a heat exchanger from which the fluid returns, cooled, to the oil reservoir. The oil reservoir, being shaped like a trough and surrounding at least part of the motor and the hydraulic pump and having high walls in the manner of a half-shell, results in a relatively high-volume oil reservoir with is a part of the fluid cooling device with a compact, space-saving structure by at least partially containing parts of the fluid cooling device to save space.

18 Claims, 5 Drawing Sheets

54
48
26
28
56
60
10
24
24
58
16
30

FLUID COOLING DEVICE

FIELD OF THE INVENTION

The present invention relates to a fluid cooling device formed as modular unit with a motor driving a fan wheel and fluid pump. The fluid pump removes the fluid out of an oil reservoir and conveys it into a hydraulic work cycle. The work cycle heats the fluid and feeds it to a heat exchanger for cooling. From the heat exchanger, the cooled fluid returns into the oil reservoir.

BACKGROUND OF THE INVENTION

DE 44 00 487 A1 discloses fluid cooling devices, also called pneumatic coolers, incorporated as compact modular units in hydraulic or liquid circuits in plants or machines. The liquid cooling is generally dependent on the input temperature differential between liquid and ambient air, on flow volume and on the flow rate of the air. Heating problems arising as a result of multi-layered operation and higher air temperature could consequently be prevented. In order to be able to use such fluid cooling devices for hydraulic work cycles of greater magnitude, the oil reservoir must be enlarged to a correspondingly large-dimensioned volume.

DE 43 37 131 A1 involves a design of a hydraulic assembly, for the enlargement of the oil reservoir volume, including a hollow capsule around a motor and pump unit of the hydraulic assembly. This design clearly complicates the free passage, for example for assembly and maintenance purposes, from the exterior to the motor and pump unit of the hydraulic assembly.

SUMMARY OF THE INVENTION

Objects of the present invention are to improve the conventional fluid cooling devices by maintaining a compact construction while making a relatively large-volume liquid or oil reservoir available and being adaptable for maintenance and assembly.

The foregoing objects are basically obtained by a fluid cooling device formed as a modular unit, comprising a motor, a fan wheel coupled to the motor to be driven thereby, and a fluid pump coupled to the motor to be driven thereby. A trough-like oil reservoir has raised trough edges and forms a half shell at least partially surrounding the motor and the fluid pump. A fluid circuit connects the oil reservoir, the pump, a hydraulic work cycle connection and a heat exchanger such that fluid can be pumped from the oil reservoir to the hydraulic work cycle connection where the fluid is heated, and can be conveyed through the fluid circuit through the heat exchanger where the fluid is cooled before being returned to the oil reservoir.

A relatively large-volume modular oil reservoir is obtained which still saves space in a compact modular manner, and is a component part of the fluid cooling device. It at least partially surrounds parts of the cooling device while saving space. The structural space left open by the trough edges provides good accessibility for assembly and maintenance purposes for the motor and fluid pump.

In one preferred embodiment of the fluid cooling device according to the present invention, between the raised trough edges of the oil reservoir, a housing part is arranged holding the fan wheel and forming an air circulation shaft for the heat exchanger through which the fluid is conveyed. Preferably, in an extension of the housing part beneath the oil reservoir, a foot part is arranged. The foot part can be constructed in the shape of a shoe, enhancing the fastening of the device. The shoe sole has fastening flanges over at least a portion of the sole length extending outward. On the basis of this foot part, a space-saving, secure fastening of the entire fluid cooling device to stationary modular parts and housing walls is facilitated.

Through the shoe-like construction of the foot part, the resulting fastening demonstrates little vibration and the modular component parts fastened on the right and left of the housing part engage the fluid cooling device as a sort of a balance on the housing part, and consequently, on the foot part.

In addition to a compact construction for the fluid cooling device, the present invention uniformly distributes the material components of the cooling device so that during operation, even with corresponding characteristic movements and vibrations, a secure state can be attained because of the fastening shoe. Other measures traditionally used to obtain balance can be deleted, which also is favorable considering the aimed-for diminution of the modular dimensions.

Other objects, advantages and salient features of the present invention will become apparent from the following detailed description, which, taken in conjunction with the annexed drawings, discloses a preferred embodiment of the present invention.

BRIEF DESCRIPTION OF THE DRAWING

Referring to the drawings which form a part of this disclosure.

DETAILED DESCRIPTION OF THE INVENTION

Figure 2:
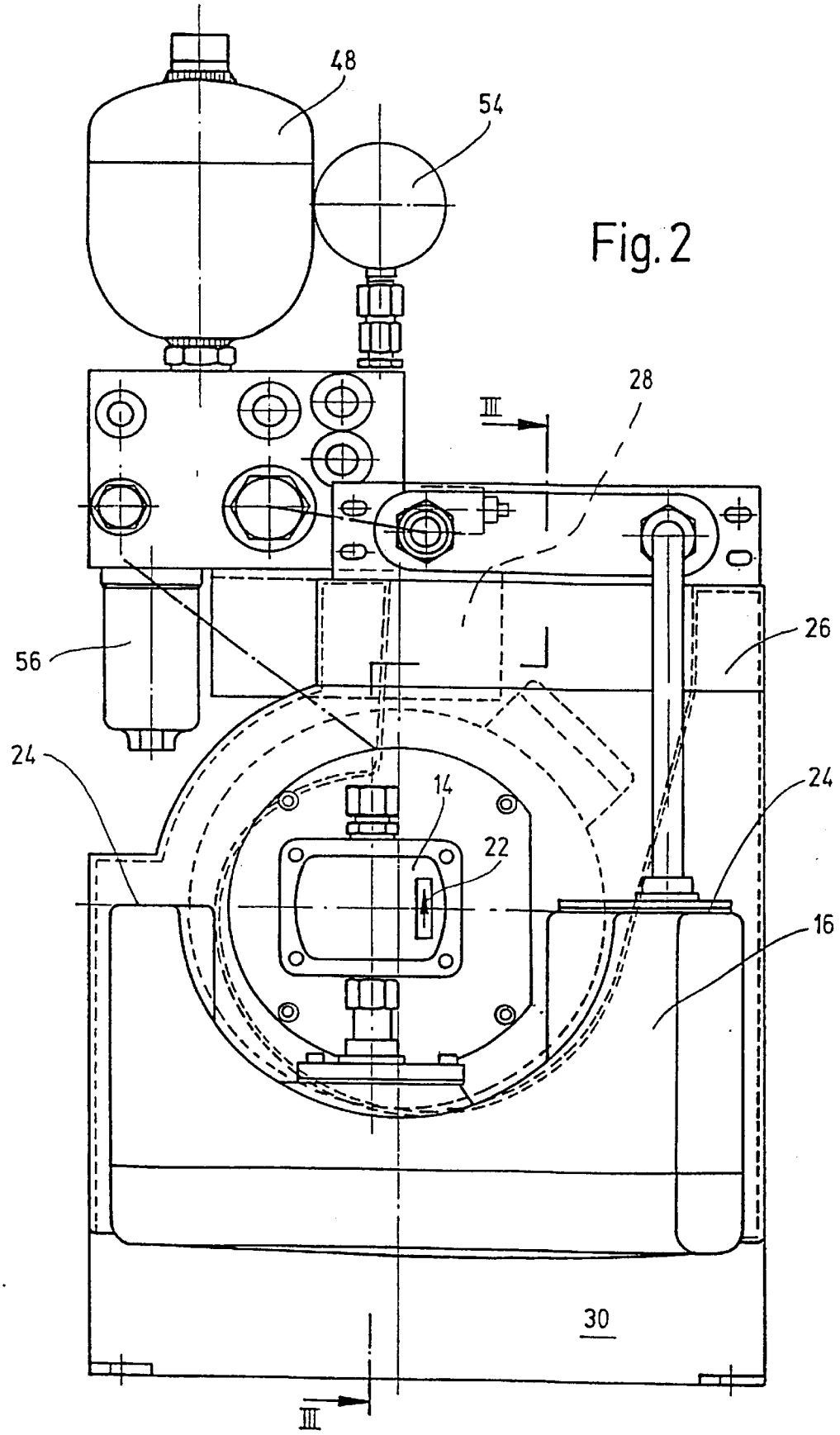
FIG. 2 is a front elevational view of the fluid cooling device of FIG. 1.
Figure 5:
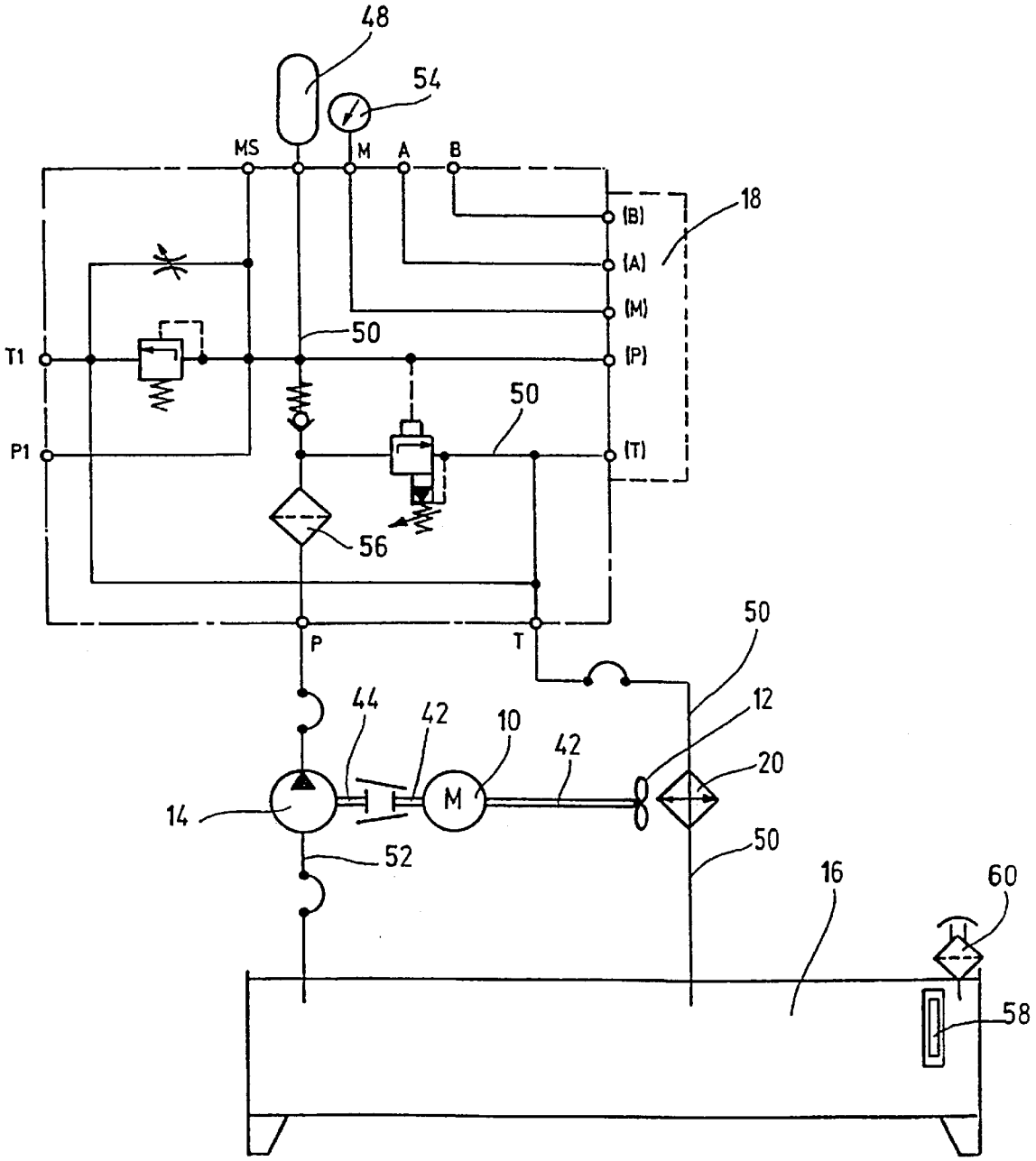
FIG. 5 is a diagram illustrating the basic circuitry of the fluid cooling device of FIG. 1.

The fluid cooling device of the present invention has an electric motor 10 which drives a fan wheel 12 and a fluid pump 14. Fluid pump 14 takes fluid from an oil reservoir 16 and conveys it into a hydraulic work cycle or circuit 18, of which the connections for the hydraulic lines are shown in FIG. 5 with the traditional abbreviated symbols. The fluid is heated in hydraulic work cycle 18 and is to be re-cooled by the fluid cooling device to a predetermined temperature. A heat exchanger 20 is used for this purpose, from which the cooled fluid returns into oil reservoir 16. The fluid drive direction of fluid pump 14 is in the direction of an arrow 22 shown in FIG. 2.

Figure 1:
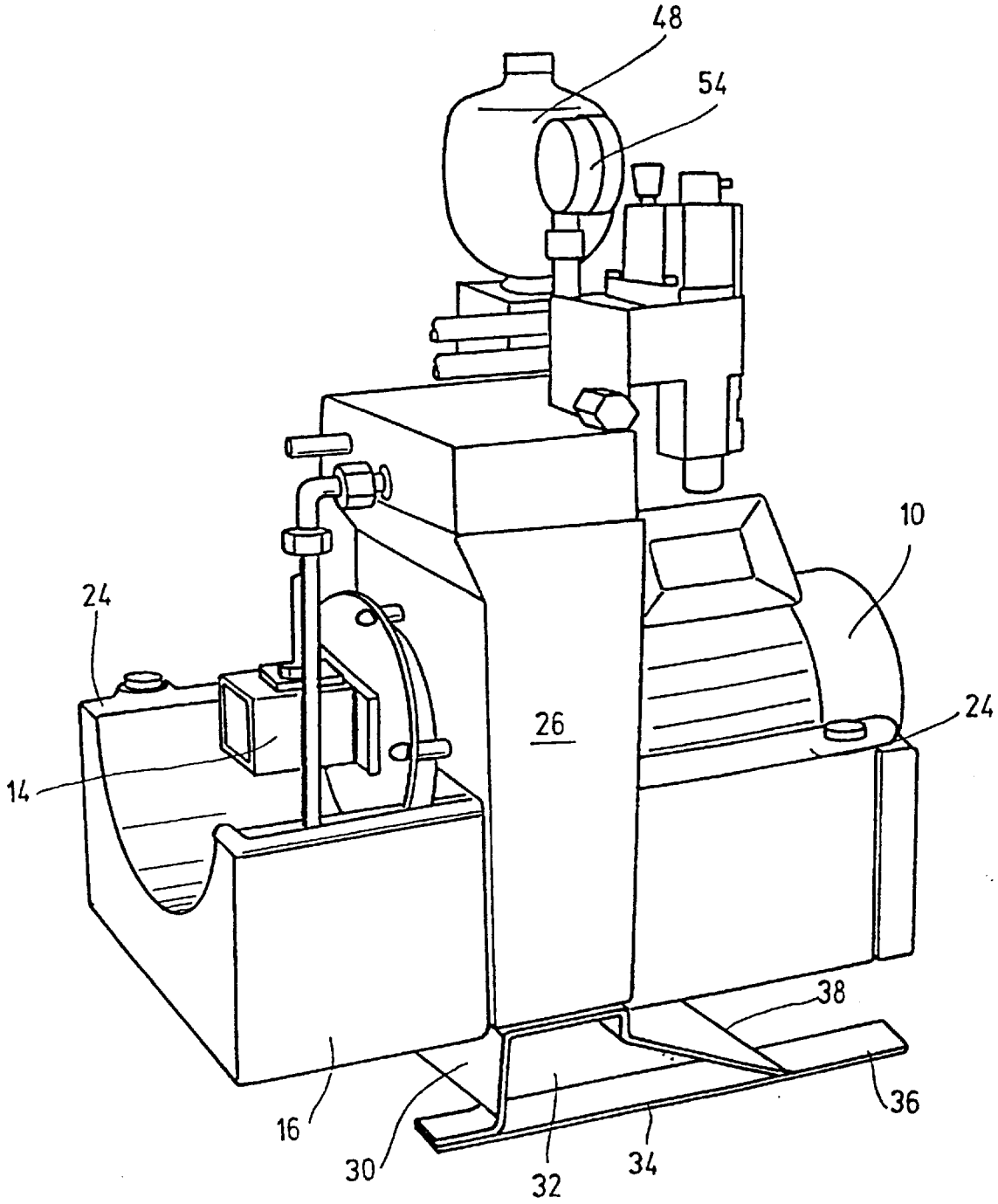
FIG. 1 is a perspective view of a fluid cooling device according to an embodiment of the present invention.

As shown particularly in FIG. 1, the oil reservoir 16 is configured to be trough-like, with raised trough edges 24, forming a sort of half shell. This shell arrangement at least partially surrounds motor 10 and fluid pump 14 from the bottom. Between the raised trough edges 24 of oil reservoir 16, a housing part 26 is arranged which holds the fan wheel 12 and forms an air circulation shaft 28 for the heat exchanger 20, through which the fluid is circulated.

Figure 3:
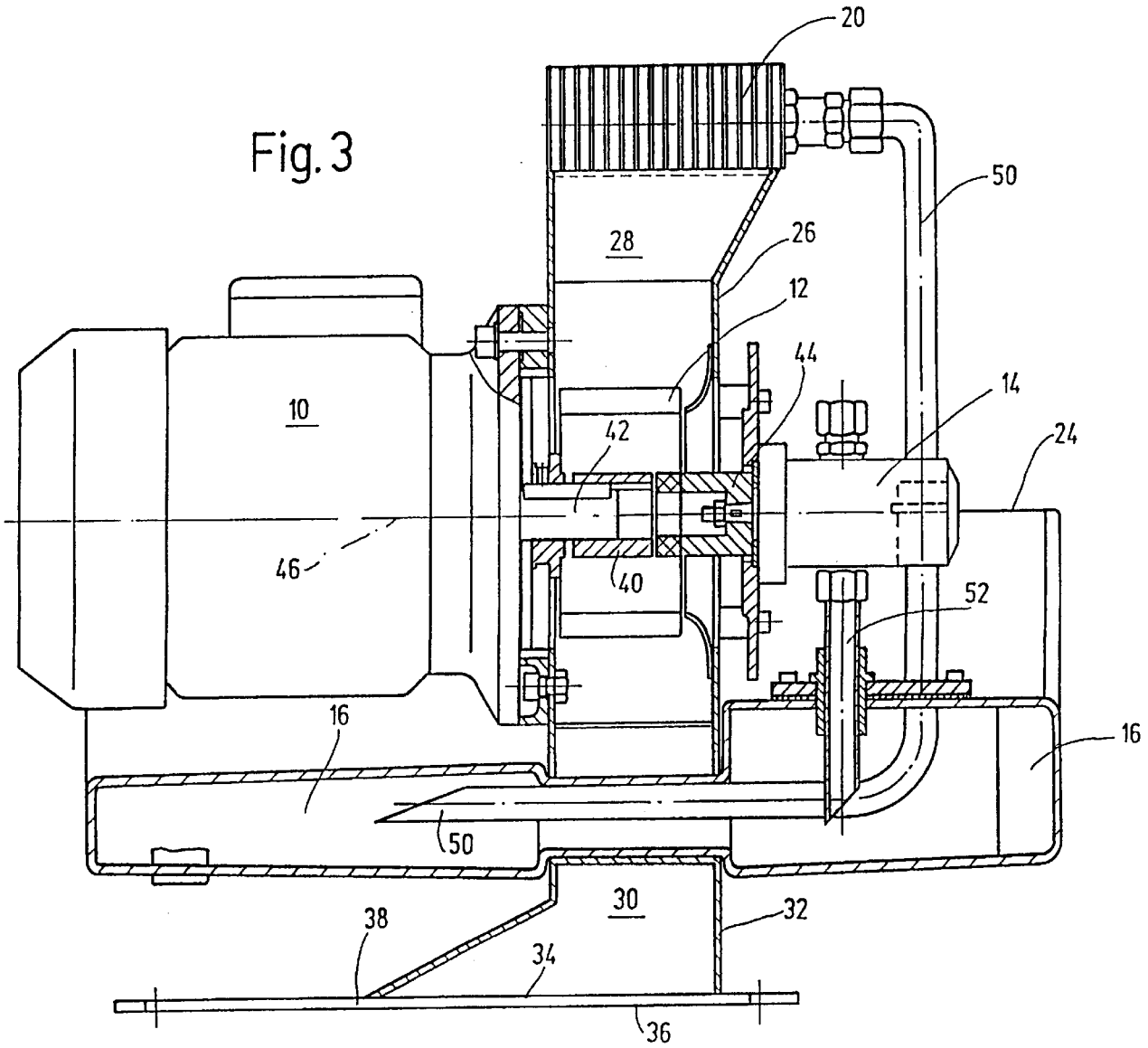
FIG. 3 is a side elevational view in section taken along line III—III of FIG. 2.
Figure 4:
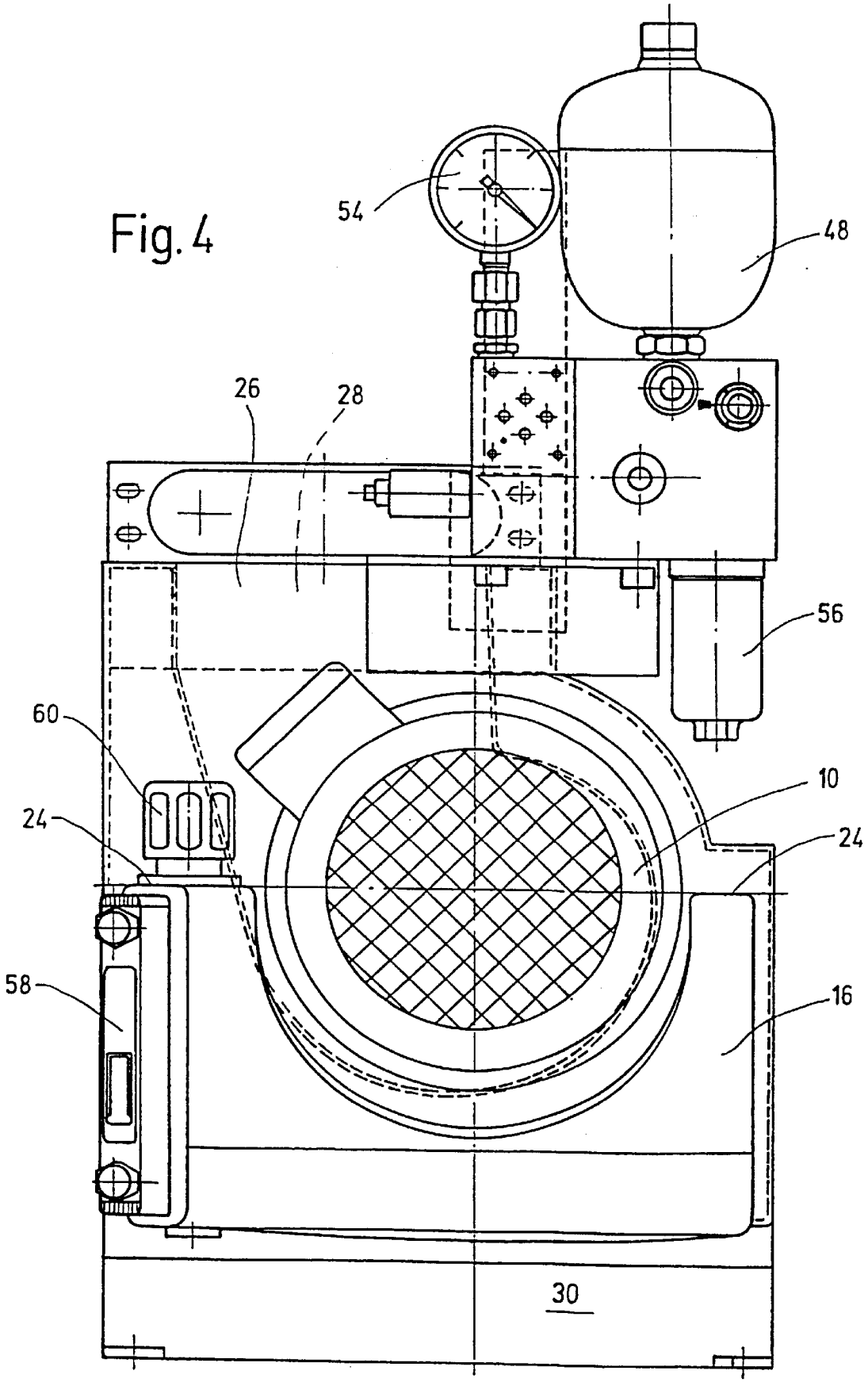
FIG. 4 is a rear elevational view of the fluid cooling device of FIG. 1.

A foot part 30 extends from housing part 26 beneath oil reservoir 16. The foot part is constructed in the shape of a shoe 32. For securing the device, the sole 34 of the shoe has two fastening flanges 36 distributed over at least part of the length of the sole extending outward, arranged opposite one another and aligned in longitudinal alignment with the fluid cooling device. The fastening shoe 32 in question, as is shown particularly in FIGS. 1 and 3, is configured as a hollow box. The toe of the shoe 38 is pointed in the direction of motor 10. Fastening shoe 32 is arranged in its hollow box-like shell construction transverse to the longitudinal alignment of the trough-like oil reservoir 16, and is in operational connection with it. Vibrations arising during the operation of the fluid cooling device can be deflected safely over the fastening shoe 32 into the appropriate upright housing device or into the ground. Such a fastening shoe 32 is embodied to be resistant to buckling. Over the oblique fastening part between shoe toe 38 and the mounting surface for the bottom of trough-like oil reservoir 16 extending horizontally particularly allows secure, vibration-resistant introduction of force into the area surrounding the fluid cooling device.

Oil reservoir 16 is of smaller dimensions in the area of motor 10 in the trough-like cross section beneath the motor, than the comparable cross section of oil reservoir 16 located beneath fluid pump 14. A system of chambers of the oil reservoir 16 having different cross section areas is obtained. Fan wheel 12 is penetrated by a drive shaft 40 or is securely connected with the drive part on impact. Fan drive shaft 40 is hollow, surrounds the drive shaft 42 of motor 10, and drives the drive axle 44 of fluid pump 14. The resulting axle and shaft arrangement is oriented coaxial to a longitudinal axis 46 of the fluid cooling device. The precise ratios are indicated especially from the sectional representation of FIG. 3.

The hydraulic work cycle 18 is in fluid-carrying connection or fluid communication with a hydraulic reservoir 48, for example, in the form of a diaphragm reservoir, of the cooling device. The diaphragm reservoir protects the pressure or work cycle against pressure deviations and can compensate for fluid volume losses. In the simpler representation of FIG. 3, the hydraulic reservoir 48 is deleted. The supply line 50 of heat exchanger 20 opens in hydraulic reservoir 48, and open in the part of oil reservoir 16 arranged beneath motor 10. A feed line 52 leading to a fluid pump 14 opens in the oil reservoir 16 arranged in the bottom of it. In some detail, the fluid cooling device has a traditional manometer 54 for the pressure monitoring, at least one filter unit 56 for the filtering of the fluid, as well as at least one indicator device 58 for fill level monitoring of oil reservoir 16. Oil reservoir 16 is also provided with a filling filter 60 for the fluid.

The functioning of the fluid cooling device is explained in greater detail relative to the circuitry plan representation or diagram shown in FIG. 5. After electric motor 10 is set in operation, motor 10 drives both fluid pump 14 and fan wheel 12 in the same direction through axle arrangements 42 and 44. Through feed line 52, fluid pump 14 receives fluid, usually hydraulic oil, from oil reservoir 16, and conveys the oil through filter unit 56 in the direction of connection P of the hydraulic work cycle 18. Manometer 54 monitors the pressure in hydraulic work cycle 18. Hydraulic reservoir 48 compensates for pressure deviations in the system. The fluid heated in hydraulic work cycle 18 returns over connection T into the fluid cooling device and proceeds through the supply line 50 into heat exchanger 20. From the heat exchanger, once suitably cooled, the fluid flows back into oil reservoir 16 for another cycle. Both the air cooling device and the hydraulic work cycle can be provided with further user connections A, B, M, MS, T1 and P1. Throttling devices as well as pressure limiting valves of traditional construction secure the hydraulic circuit against overloading.

The fluid cooling device of the present has an extraordinarily compact modular structure. Additionally, high volumes of fluid can be stored in the trough-shaped oil reservoir. A secure state of low vibration during operation of the device can be attained because of the foot part of the cooling device.

While various embodiments have been chosen to illustrate the invention, it will be understood by those skilled in the art that various changes and modifications can be made therein without departing from the scope of the invention as defined in the appended claims.

What is claimed is:

1. A fluid cooling device formed as a modular unit, comprising:

a motor;

a fan wheel coupled to said motor to be driven thereby;

a fluid pump coupled to said motor to be driven thereby;

a trough-like oil reservoir having raised trough edges and forming a half shell of least partially surrounding said motor and said fluid pump;

a work cycle connection;

a heat exchanger;

a fluid circuit connecting said oil reservoir, said pump, said hydraulic work cycle connection and said heat exchanger such that fluid can be pumped from said oil reservoir to said hydraulic work cycle connection where the fluid is heated, and can be conveyed back through said fluid circuit to pass through said heat exchanger where the fluid is cooled before being returned to the oil reservoir; and a housing part, arranged between said trough edges of said oil reservoir, holding said fan wheel and forming an air circulation shaft for said heat exchanger.

2. A fluid cooling device according to claim 1 wherein a foot part is arranged as an extension of said housing part beneath said oil reservoir to secure the fluid cooling device, said foot part being generally configured as a shoe and having fastening flanges facing outwardly on at least a part of the length of a sole of said shoe.

3. A fluid cooling device according to claim 2 wherein said shoe is hollow and box-like and has a toe pointing toward said motor.

4. A fluid cooling device according to claim 1 wherein said oil reservoir has smaller dimensions in cross section adjacent and beneath said motor than adjacent and beneath said fluid pump.

5. A fluid cooling device according to claim 1 wherein a hollow drive shaft penetrates said fan wheel, and surrounds a drive shaft of said motor and a drive shaft of said fluid pump.

6. A fluid cooling device according to claim 1 wherein a hydraulic reservoir is fluid communication with said work cycle connection.

7. A fluid cooling device according to claim 6 wherein said fluid circuit comprises a supply line of said heat exchanger opening into said hydraulic reservoir and opening into a part of said oil reservoir beneath said motor, and a feed line leading to said fluid pump opening into said oil reservoir arranged beneath said fluid pump.

8. A fluid cooling device according to claim 1 wherein said fluid circuit comprises a manometer for pressure monitoring, at least one filter unit for filtering fluids and at least one indicator for monitoring fluid level in said oil reservoir.

9. A fluid cooling device according to claim 1 wherein said oil reservoir comprises a filling filter for fluid.

10. A fluid cooling device formed as a modular unit, comprising:

a motor;

a fan wheel coupled to said motor to be driven thereby;

a fluid pump coupled to said motor to be driven thereby;

a trough-like oil reservoir having raised trough edges and forming a half shell at least partially surrounding said motor and said fluid pump, said oil reservoir having smaller dimensions in cross section adjacent and beneath said motor than adjacent and beneath said fluid pump;

a work cycle connection;

a heat exchanger; and a fluid circuit connecting said oil reservoir, said pump, said hydraulic work cycle connection and said heat exchanger such that fluid can be pumped from said oil reservoir to said hydraulic work cycle connection where the fluid is heated, and can be conveyed back through said fluid circuit to pass through said heat exchanger where the fluid is cooled before being returned to the oil reservoir.

11. A fluid cooling device according to claim 10 wherein a foot part is arranged as an extension of said housing part beneath said oil reservoir to secure the fluid cooling device, said foot part being generally configured as a shoe and having fastening flanges facing outwardly on at least a part of the length of a sole of said shoe.

12. A fluid cooling device according to claim 10 wherein said shoe is hollow and box-like and has a toe pointing toward said motor.

13. A fluid cooling device according to claim 10 wherein a hollow drive shaft penetrates said fan wheel, and surrounds a drive shaft of said motor and a drive shaft of said fluid pump.

14. A fluid cooling device according to claim 10 wherein said fluid circuit comprises a supply line of said heat exchanger opening into said hydraulic reservoir and opening into a part of said oil reservoir beneath said motor, and a feed line leading to said fluid pump opening into said oil reservoir arranged beneath said fluid pump.

15. A fluid cooling device according to claim 10 wherein said fluid circuit comprises a manometer for pressure monitoring, at least one filter unit for filtering fluids and at least one indicator for monitoring fluid level in said oil reservoir.

16. A fluid cooling device formed as a modular unit, comprising:

a motor;

a fan wheel coupled to said motor to be driven thereby;

a fluid pump coupled to said motor to be driven thereby;

a trough-like oil reservoir having raised trough edges and forming a half shell at least partially surrounding said motor and said fluid pump;

a work cycle connection;

a hydraulic reservoir;

a heat exchanger; and a fluid circuit connecting said oil reservoir, said pump, said hydraulic work cycle connection and said heat exchanger such that fluid can be pumped from said oil reservoir to said hydraulic work cycle connection where the fluid is heated, and can be conveyed back through said fluid circuit to pass through said heat exchanger where the fluid is cooled before being returned to the oil reservoir, said fluid circuit including a supply line of said heat exchanger opening into said hydraulic reservoir and opening into a part of said oil reservoir beneath said motor and a feed line leading to said fluid pump opening into said oil reservoir arranged beneath said fluid pump.

17. A fluid cooling device according to claim 16 wherein said fluid circuit comprises a manometer for pressure monitoring, at least one filter unit for filtering fluids and at least one indicator for monitoring fluid level in said oil reservoir.

18. A fluid cooling device formed as a modular unit, comprising:

a motor;

a fan wheel coupled to said motor to be driven thereby;

a fluid pump coupled to said motor to be driven thereby;

a trough-like oil reservoir having raised trough edges and forming a half shell at least partially surrounding said motor and said fluid pump;

a work cycle connection;

a heat exchanger; and a fluid circuit connecting said oil reservoir, said pump, said hydraulic work cycle connection and said heat exchanger such that fluid can be pumped from said oil reservoir to said hydraulic work cycle connection where the fluid is heated, and can be conveyed back through said fluid circuit to pass through said heat exchanger where the fluid is cooled before being returned to the oil reservoir, said fluid circuit includes a manometer for pressure monitoring, at least one filter unit for filtering fluids and at least one indicator for monitoring fluid level in said oil reservoir.

* * * * *